US012338515B2

(12) United States Patent
Lee

(10) Patent No.: US 12,338,515 B2
(45) **Date of Patent: *Jun. 24, 2025**

(54) ULTRA-THICK STEEL EXCELLENT IN BRITTLE CRACK ARRESTABILITY AND MANUFACTURING METHOD THEREFOR

(71) Applicant: POSCO, Pohang-si (KR)

(72) Inventor: Hak-Cheol Lee, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 814 days.

This patent is subject to a terminal disclaimer.

(21) Appl. No.: 17/297,940

(22) PCT Filed: Nov. 29, 2019

(86) PCT No.: PCT/KR2019/016702

§ 371 (c)(1),
(2) Date: May 27, 2021

(87) PCT Pub. No.: WO2020/111860

PCT Pub. Date: Jun. 4, 2020

(65) Prior Publication Data

US 2022/0025491 A1 Jan. 27, 2022

(30) Foreign Application Priority Data

Nov. 30, 2018 (KR) ..... 10-2018-0151871

(51) Int. Cl.

| | |
|---|---|
| ***C22C 38/04*** | (2006.01) |
| ***C21D 1/18*** | (2006.01) |
| ***C21D 8/00*** | (2006.01) |
| ***C21D 8/02*** | (2006.01) |
| ***C22C 38/00*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |

(52) U.S. Cl.

CPC ..... *C22C 38/04* (2013.01); *C21D 1/18* (2013.01); *C21D 8/005* (2013.01); *C21D 8/021* (2013.01); *C22C 38/002* (2013.01); *C22C 38/08* (2013.01); *C22C 38/12* (2013.01); *C22C 38/14* (2013.01); *C22C 38/16* (2013.01); *C21D 2211/002* (2013.01); *C21D 2211/005* (2013.01); *C21D 2211/008* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 2017/0327922 | A1 | 11/2017 | Lee et al. | |
| 2017/0335424 | A1 | 11/2017 | Lee et al. | |
| 2017/0342518 | A1 | 11/2017 | Lee et al. | |
| 2018/0363081 | A1* | 12/2018 | Lee | C21D 8/0226 |
| 2019/0093204 | A1 | 3/2019 | Lee et al. | |
| 2019/0390292 | A1* | 12/2019 | Lee | C22C 38/08 |
| 2022/0056544 | A1* | 2/2022 | Lee | C21D 8/005 |

FOREIGN PATENT DOCUMENTS

| | | | | |
|---|---|---|---|---|
| CN | 108368587 | A | 8/2018 | |
| CN | 108660389 | A | 10/2018 | |
| EP | 2520683 | A2 | 11/2012 | |
| EP | 3239330 | A1 | 11/2017 | |
| EP | 3239332 | A1 | 11/2017 | |
| EP | 3561132 | A1 | 10/2019 | |
| JP | 2010-100903 | A | 5/2010 | |
| JP | 2013-221190 | A | 10/2013 | |
| JP | 2013-245360 | A | 12/2013 | |
| KR | 10-2011-0075321 | A | 7/2011 | |
| KR | 10-2016-0078668 | A | 7/2016 | |
| KR | 10-2016-0078926 | A | 7/2016 | |
| KR | 10-2016-0078927 | A | 7/2016 | |
| KR | 10-2016-0078928 | A | 7/2016 | |
| KR | 10-2016-0079163 | A | 7/2016 | |
| KR | 10-1819356 | B1 | 1/2018 | |
| KR | 10-2018-0073091 | A | 7/2018 | |
| WO | WO-2011081349 | A2 * | 7/2011 | C21D 8/0221 |
| WO | WO-2017095175 | A1 * | 6/2017 | C21D 8/0205 |
| WO | 2018/117767 | A1 | 6/2018 | |

OTHER PUBLICATIONS

Chinese Office Action dated Apr. 26, 2022 issued in Chinese Patent Application No. 201980078893.2 (with English translation).

International Search Report dated Jun. 19, 2020 issued in International Patent Application No. PCT/KR2019/016702 (with English translation).

Extended European Search Report dated Feb. 3, 2022 issued in European Patent Application No. 19891138.0.

* cited by examiner

*Primary Examiner* — Jophy S. Koshy

(74) *Attorney, Agent, or Firm* — Morgan Lewis & Bockius LLP

(57) ABSTRACT

An ultra-thick steel excellent in brittle crack arrestability according to an aspect of the present invention comprises, by weight, C: 0.02-0.07%, Mn: 1.8-2.2%, Ni: 0.7-1.2%, Nb: 0.005-0.02%, Ti: 0.005-0.02%, Cu: 0.1-0.4%, P: 0.01% or less, S: 0.004% or less, and the balance of Fe and inevitable impurities, wherein crystal grains that have a high angle grain boundary of 15 degrees or more, as measured by EBSD, may have an average grain size of 15 μm or less in the t/4−(3*t)/8 region (wherein t represents a thickness of the steel, the same below).

5 Claims, 1 Drawing Sheet

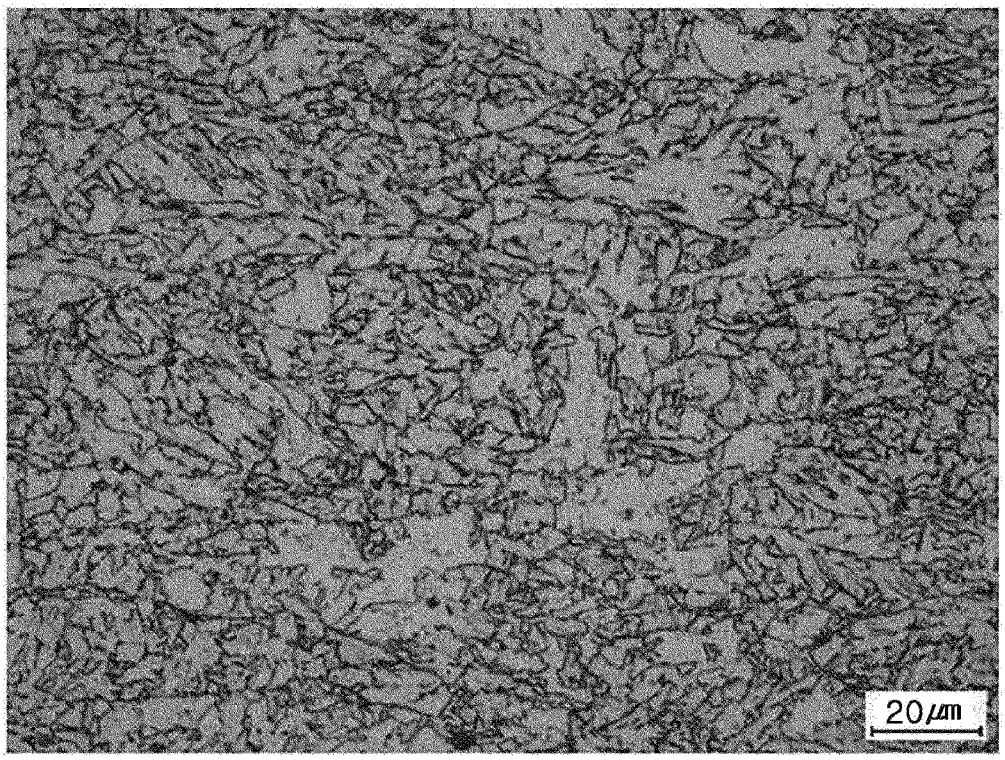
20μm

ULTRA-THICK STEEL EXCELLENT IN BRITTLE CRACK ARRESTABILITY AND MANUFACTURING METHOD THEREFOR

CROSS-REFERENCE OF RELATED APPLICATIONS

This application is the U.S. National Phase under 35 U.S.C. § 371 of International Patent Application No. PCT/KR2019/016702, filed on Nov. 29, 2019, which in turn claims the benefit of Korean Application Nos. 10-2018-0151871, filed on Nov. 30, 2018, the entire disclosures of which applications are incorporated by reference herein.

TECHNICAL FIELD

The present disclosure relates to an ultra-thick steel excellent in brittle crack arrestability and a manufacturing method therefor, and more particularly, to an ultra-thick steel excellent in brittle crack arrestability capable of effectively securing brittle crack arrestability as a Nil-Ductility transition temperature (NDTT) value based on ¼t is −45° C. or lower, and a manufacturing method therefor.

BACKGROUND ART

In recent years, the development of high-strength ultra-thick steels has been demanded in the design of structures such as ships. In the case of manufacturing structures such as ships using high-strength steel, it is possible not only to reduce a weight of the structures by reducing a thickness of steel, but also to secure ease of processing and welding work due to the reduction in the thickness of the steel.

In general, when manufacturing high-strength ultra-thick steel, the entire structure thereof is not sufficiently deformed due to a decrease in a total rolling reduction ratio, and thus, becomes coarse, and a difference in a cooling rate between a surface portion and a central portion occurs due to the thick thickness during rapid cooling for securing. As a result, a large amount of coarse low-temperature transformed structures such as bainite are generated on the surface portion, thereby making it difficult to secure toughness. In particular, when the brittle crack arrestability indicating the stability of the structure is applied to major structures such as ships, the number of cases requiring a guarantee is increasing. However, in the case of the ultra-thick steel, it is difficult to guarantee such brittle crack arrestability due to the decrease in toughness.

Actually, many ship associations and steel companies may perform a high tensile test that may accurately evaluate the actual brittle crack arrestability to guarantee the brittle crack arrestability. However, in order to perform such a high tensile test, a huge cost is incurred. Accordingly, in mass production, it is difficult to guarantee the brittle crack arrestability by applying such a high tensile test. In order to improve the irrationality, research on a small tensile test that may replace the high tensile test has been continuously performed recently. As the most promising test, naval research laboratory-drop weight test (NRL-DWT) specified in ASTM E208-06 standard on the surface portion has been adopted by many ship associations and steel companies.

The NRL-DWT test on the surface portion has been adopted based on the existing research results that the brittle crack arrestability is excellent by slowing the crack propagation speed during the brittle crack arrestability when the microstructure of the surface portion is controlled, but since the NRL-DWT test is performed by collecting a specimen from the surface portion of the steel, there is an opinion that the NRL-DWT has a property that may guarantee brittle crack arrestability in thick steels with a thickness of 80 mm or more, which are recently applied to structures such as ships.

In addition, the surface portion of the steel is a region to which a fast cooling rate is applied during water cooling compared to the central portion or a t/4 portion of steel (here, t refers to the thickness of the steel, the same below). In steels with high hardenability, such as steel with a yield strength of 500 MPa-grade, a large amount of low-temperature transformation phase may be formed. Therefore, despite the excellent index related to the brittle crack arrestability measured in the actual high tensile test, the NRL-DWT test results tend to be evaluated poorly.

Recently, there is a tendency of determining the brittle arrestability characteristics of the high-strength ultra-thick steel of 500 MPa-grade or higher by performing the NRL-DWT test on the t/4 portion of the steel, instead of performing the NRL-DWT test on the surface portion of the steel as in the existing test method. Therefore, there is a need for development of a high-strength ultra-thick steel capable of guaranteeing properties of NRL-DWT of a t/4 portion, and a manufacturing method therefor.

RELATED ART DOCUMENT (Patent Document 1) Korean Patent Laid-Open Publication No. 10-2016-0079163 (published on Jul. 6, 2016)

DISCLOSURE

Technical Problem

An aspect of the present disclosure is to provide an ultra-thick steel excellent in brittle crack arrestability, and a manufacturing method therefor.

An object of the present disclosure is not limited to the abovementioned contents. Those skilled in the art will have no difficulty in understanding an additional object of the present disclosure from the general contents of present specification.

Technical Solution

According to an aspect of the present disclosure, an ultra-thick steel excellent in brittle crack arrestability includes: by wt %, 0.02 to 0.07% of C, 1.8 to 2.2% of Mn, 0.7 to 1.2% of Ni, 0.005 to 0.02% of Nb, 0.005 to 0.02% of Ti, 0.1 to 0.4% of Cu, 0.01% or less of P, 0.004% or less of S, and a balance of Fe and inevitable impurities, wherein grains that have a high angle grain boundary of 15° or more, as measured by EBSD, may have an average grain size of 15 μm or less in the t/4−(3*t)/8 region (wherein t represents a thickness of the steel, the same below).

When the naval research laboratory-drop weight test (NRL-DWT) specified in ASTM E208-06 is performed on a specimen collected in the t/4 region, a Nil-ductility transition (NDT) temperature may be −45° or less.

The impact transition temperature of the specimen collected in the t/4 region of the steel may be −60° C.□ or lower.

A microstructure of a test piece collected in the t/4 region of the steel may include a composite structure of acicular ferrite and granular bainite, and may further include island martensite as a second phase.

The acicular ferrite may be included in a ratio of 60 to 80 area %, the granular bainite in a ratio of 20 to 40 area %, and the island martensite is included in a ratio of 10 area % or less.

A thickness of the steel may be 50 to 120 mm.

A yield strength of the steel may be 500 MPa or more.

According to another aspect of the present disclosure, a manufacturing method of an ultra-thick steel excellent in brittle crack arrestability includes: reheating a slab including, by wt %, 0.02 to 0.07% of C, 1.8 to 2.2% of Mn, 0.7 to 1.2% of Ni, 0.005 to 0.02% of Nb, 0.005 to 0.02% of Ti, 0.1 to 0.4% of Cu, 0.01% or less of P, 0.004% or less of S, and the balance of Fe and inevitable impurities; rough rolling the reheated slab; finishing rolling the roughly rolled slab at a cumulative reduction rate of 50% or more; and cooling the finishing-rolled steel material.

The slab may be reheated in a temperature range of 1000 to 1120° C.

The reheated slab may be roughly rolled at a cumulative rolling reduction rate of 40% or more in a temperature range of 850 to 1050° C.

The finishing rolling may be initiated in a temperature range of 700 to 850° C.

The finishing-rolled steel may be cooled to a temperature range of 500° C. or lower at a cooling rate of 3° C./s or more.

The technical solution does not enumerate all of the features of the present description, and various features of the present disclosure and advantages and effects according to the various features will be understood in more detail with reference to the following specific exemplary embodiments.

Advantageous Effects

As set forth above, according to an exemplary embodiment in the present disclosure, it is possible to provide an ultra-thick steel which may effectively guarantee brittle crack arrestability while having high strength characteristics, and thus, is particularly suitable as materials of structures such as ships, and a manufacturing method therefor.

DESCRIPTION OF DRAWINGS

FIG. 1 is a photograph of observing a t/4 portion of specimen 1 with an optical microscope.

BEST MODE FOR INVENTION

The present disclosure relates to an ultra-thick steel excellent in brittle crack arrestability and a manufacturing method therefor. Hereinafter, exemplary embodiments in the present disclosure will be described. Exemplary embodiments in the present disclosure may be modified into several forms, and it is not to be interpreted that the scope of the present disclosure is limited to exemplary embodiments described below. The present exemplary embodiments are provided in order to further describe the present disclosure in detail to those skilled in the art to which the present disclosure pertains.

Hereinafter, compositions of steel according to the present disclosure will be described in more detail. Hereinafter, unless otherwise indicated, % indicating a content of each element is based on weight.

An ultra-thick steel having excellent brittle crack arrestability according to an exemplary embodiment in the present disclosure may include, by wt %, 0.02 to 0.07% of C, 1.8 to 2.2% of Mn, 0.7 to 1.2% of Ni, 0.005 to 0.02% of Nb, 0.005 to 0.02% of Ti, 0.1 to 0.4% of Cu, 0.01% or less of P, 0.004% or less of S, and the balance of Fe and inevitable impurities.

Carbon (C): 0.02 to 0.07%

Carbon (C) is the most effective element in securing strength of steel, and therefore, needs to be contained in the steel within an appropriate range. The present disclosure may limit a lower limit of a content of carbon (C) to 0.02% to secure strength. The lower limit of the content of carbon (C) may be preferably 0.03%. However, when carbon (C), which is an element for improving hardenability, is excessively added, there may be a risk of a decrease in toughness due to the generation of a large amount of island martensite and a low-temperature transformation phase. As a result, the present disclosure may limit an upper limit of the content of carbon (C) to 0.07%. The upper limit of the content of carbon (C) may be preferably 0.06%.

Manganese (Mn): 1.8 to 2.2%

Manganese (Mn) is an element that effectively improves strength of steel through solid solution strengthening and improvement in hardenability. The present disclosure may limit a lower limit of a content of manganese (Mn) to 1.8% in order to secure a yield strength of 500 MPa or more. However, when manganese (Mn) is excessively added, there may be a risk of a decrease in impact toughness due to a promotion of generation of upper bainite and martensite due to an excessive increase in hardenability, and a decrease in t/4 portion (where t represents a thickness of the steel, the same below) NRL-DWT properties. As a result, the present disclosure may limit an upper limit of the content of manganese (Mn) to 2.2%. The upper limit of the content of manganese (Mn) may be preferably 2.1%.

Nickel (Ni) 0.7 to 1.2%

Nickel (Ni) is an element contributing to improvement in impact toughness by facilitating a cross slip of dislocations at low temperature, and is also an element contributing to improvements in the strength of steel by improvements in hardenability. The present disclosure may limit a lower limit of the content of nickel (Ni) to 0.7% in order to achieve such an effect. The lower limit of the content of nickel (Ni) may be preferably 0.75%. However, when nickel (Ni) is excessively added, there may be a problem in that the manufacturing cost excessively increases, which is undesirable in terms of economic efficiency, and a large amount of low-temperature transformation structure is generated due to improvement in hardenability. As a result, an upper limit of a content of nickel (Ni) may be limited to 1.2%. The upper limit of the content of nickel (Ni) may be preferably 1.15%.

Niobium (Nb): 0.005 to 0.02%

Niobium (Nb) is an element that contributes to improvement in strength of a base metal by being precipitated as carbide or nitride. In addition, niobium (Nb) solid-dissolved during high-temperature reheating is an element that effectively contributes to refining a structure since it precipitates very finely in the form of carbide (NbC) during rolling to suppress recrystallization of austenite. The present disclosure may limit a lower limit of a content of niobium (Nb) to 0.005% to achieve such an effect. However, when niobium (Nb) is excessively added, there may be a possibility of causing brittle cracks at corners of steel, and there may be a problem of a decrease in toughness due to generation of excessive precipitates and generation of a large amount of island martensite. As a result, the present disclosure may limit an upper limit of the content of niobium (Nb) to 0.02%. The upper limit of the content of niobium (Nb) may be preferably 0.017%.

Titanium (Ti) 0.005 to 0.02%

Titanium (Ti) is an element that effectively contributes to improvement in low-temperature toughness because it suppresses a growth of crystal grains in a base metal and a heat-affected portion of welding by forming TiN precipitates. The present disclosure may limit the amount of titanium (Ti) added to 0.005% or more to form the TiN precipitates. However, when titanium (Ti) is excessively added, there may be a problem in that low-temperature toughness is rather inferior due to coarse TiN crystallization. As a result, the present disclosure may limit an upper limit of the content of titanium (Ti) to 0.02%. The upper limit of the content of titanium (Ti) may be preferably 0.015%.

Copper (Cu): 0.1 to 0.4%

Copper (Cu) is an element that contributes to improving hardenability and improving strength of steel by solid solution strengthening. In addition, copper (Cu) is an element that contributes to improvement in yield strength by generating epsilon copper (Cu) precipitates during heat treatment. The present disclosure may add 0.1% or more of copper (Cu) to achieve such an effect of improving strength. A lower limit of a content of copper (Cu) may be preferably 0.15%. However, when copper (Cu) is excessively added, slab cracking due to hot shortness may be caused in a steel making process. As a result, the present disclosure may limit an upper limit of the content of copper (Cu) to 0.4%. The upper limit of the content of copper (Cu) may be preferably 0.35%.

Phosphorus (P): 0.01% or Less, Sulfur (S): 0.004% or Less,

Phosphorus (P) and sulfur (S) are elements that cause brittleness by inducing brittleness in crystal grains or by forming coarse inclusions. As a result, the present disclosure may limit contents of phosphorus (P) and sulfur (S) to 0.01% or less and 0.004% or less, respectively, to secure brittle crack arrestability.

In the present disclosure, in addition to the above-described steel composition, the balance may be Fe and inevitable impurities. The inevitable impurities may be unintentionally incorporated in a conventional steel manufacturing process, and therefore, may not be completely excluded, and those skilled in the field of steel making may easily understand the meaning. In addition, the present disclosure does not entirely exclude addition of compositions other than the above-described steel composition.

Grains having a high angle grain boundary of 15° or more measured by EBSD in t/4 to (3*t)/8 region (where t represents a thickness of steel, the same below) of steel according to an exemplary embodiment in the present disclosure may have an average grain size of 15 μm or less.

When performing the naval research laboratory-drop weight test (NRL-DWT) specified in ASTM E208-06 on a test piece collected in the t/4 region of the steel according to an exemplary embodiment in the present disclosure, Nil-ductility transition (NDT) temperature may be −45° C. or lower, and the NDT temperature in the t/4 region may be more preferably −50° C. or lower.

The impact transition temperature of the test piece collected in the t/4 region of the steel according to an exemplary embodiment in the present disclosure may be −60° C. or lower, and may be more preferably −70° C. or lower.

The microstructure of the test piece collected in the t/4 region of the steel according to an exemplary embodiment in the present disclosure may include a composite structure of acicular ferrite and granular bainite, and may further include island martensite as a second phase. In this case, a fraction of the acicular ferrite in the t/4 region may be 60 to 80 area %, and a fraction of the granular bainite in the t/4 region may be 20 to 40 area %. In addition, suppressing the generation of the second phase is more preferable in terms of securing toughness, and a fraction of the island martensite of the present disclosure may be 10 area % or less based on the t/4 region.

When the microstructure is generated in the form of a composite structure of the acicular ferrite and the granular bainite, the acicular ferrite generated at high temperature is simultaneously generated at grain boundaries and within the grain boundaries, and then the granular bainite is generated from the remainder austenite to suppress the generation of coarse bainite packets, thereby refining the t/4 portion structure. In addition, since it is difficult to secure a yield strength of 500 MPa or more with the acicular ferrite alone, it is necessary to secure strength by producing granular bainite to be 20 to 40 area %. Since the island martensite acts as a crack initiation point during deformation, it is preferable to suppress the fraction of the island martensite as much as possible in terms of securing the impact toughness and the NRL-DWT properties.

The thickness of the steel according to an exemplary embodiment in the present disclosure may be 50 to 120 mm. The steel may preferably have a thickness of 50 to 100 mm, and more preferably a thickness of 70 to 100 mm.

The yield strength of the steel according to an exemplary embodiment in the present disclosure may be 500 MPa or more, and more preferably 520 MPa or more.

Therefore, according to an exemplary embodiment in the present disclosure, it is possible to provide an ultra-thick steel which may effectively guarantee brittle crack arrestability while having high strength characteristics, and thus, is particularly suitable as materials of structures such as ships.

A manufacturing method of the present disclosure will hereinafter be described in more detail.

The ultra-thick steel excellent in brittle crack arrestability according to an exemplary embodiment in the present disclosure may be manufactured by reheating a slab including, by wt %, 0.02 to 0.07% of C, 1.8 to 2.2% of Mn, 0.7 to 1.2% of Ni, 0.005 to 0.02% of Nb, 0.005 to 0.02% of Ti, 0.1 to 0.4% of Cu, 0.01% or less of P, 0.004% or less of S, and the balance of Fe and inevitable impurities, rough rolling the reheated slab, performing finishing rolling on the roughly rolled slab at a cumulative rolling reduction rate of 50% or more at a finishing rolling starting temperature of 700 to 850° C., and cooling the finishing rolled steel.

Reheating Slab

Since the slab of the present disclosure is provided with an alloy composition corresponding to an alloy composition of the steel described above, the description of the alloy compositions of the slab of the present disclosure is replaced by the description of the alloy composition of the steel described above.

The slab having the compositions described above may be reheated in a temperature range of 1000 to 1120° C. In order to solid-dissolve Ti and/or Nb carbonitride formed during casting, it is preferable to reheat the slab in a temperature range of 1000° C. or higher. However, when the reheating temperature of the slab is excessively high, there is a risk of coarsening of austenite, so it is preferable to perform the reheating of the slab in a temperature range of 1120° C. or lower.

Rough Rolling

Rough rolling may be performed to adjust the shape of the reheated slab. The coarse austenite refinement may be achieved through recrystallization along with destruction of the cast structure such as dendrite formed during casting by the rough rolling. In order to obtain such an effect, the temperature of the rough rolling may be limited to a range of 850 to 1050° C. In order to refine the structure by sufficient recrystallization, the rough rolling may be performed under the condition of a total cumulative rolling reduction ratio of 40% or more.

Finishing Rolling

Finishing rolling is an important process of securing the structure and properties of the t/4 portion of the steel for the purpose of the present disclosure, so the process conditions need to be strictly controlled. The finishing rolling may be performed to introduce a non-uniform microstructure into the austenite of the roughly rolled steel, and may be performed in a temperature range of 700 to 850° C. so that the strain applied to the t/4 portion of the steel may be maintained. In addition, in order to achieve the particle size refinement effect, the finishing rolling may be performed under the conditions of the total cumulative reduction ratio of 50% or more.

When the starting temperature of the finishing rolling is less than 700°, it may be difficult to achieve a fine grain size of the t/4 portion due to the decrease in the rolling reduction ratio due to facility limitations, and polygonal ferrite is generated in the t/4 portion of the steel, and thus, the steel may not secure the desired level of strength. In addition, when the starting temperature of the finishing rolling exceeds 850° C., the steel is exposed to high temperature, and thus, a dislocation band is reduced due to deformation, so the sufficient structure refinement effect at the t/4 portion may not be achieved. Therefore, the finishing rolling of the present disclosure is preferably initiated in the temperature range of 700 to 850° C., and the starting temperature of the finishing rolling may be in the range of 730 to 850° C.

Cooling

After the finishing rolling, the steel may be cooled. The cooling method of the present disclosure is not particularly limited, but water cooling may be preferable in terms of cooling efficiency. The finishing-rolled steel may be cooled to a temperature range of 500° C. or less at a cooling rate of 3° C./s or higher. When the cooling rate is less than 3° C./s, the microstructure at the central portion of the steel is not properly formed, so the yield strength may decrease. In addition, when the cooling ending temperature exceeds 500° C., the microstructure of the steel is not properly formed, so the yield strength may decrease.

The grains having a high angle grain boundary of 15° or more measured by EBSD in t/4 to (3*t)/8 region (where t represents a thickness of steel, the same below) of the steel manufactured by the manufacturing method according to the exemplary embodiment in the present disclosure may have an average grain size of 15 μm or less.

When performing the naval research laboratory-drop weight test (NRL-DWT) specified in ASTM E208-06 on a test piece collected in the t/4 region of the steel manufactured by the manufacturing method according to the exemplary embodiment in the present disclosure, the Nil-ductility transition (NDT) temperature may be −45° C. or lower, and the NDT temperature in the t/4 region may be more preferably −50° C. or lower.

The impact transition temperature of the test piece collected in the t/4 region of the steel manufactured by the manufacturing method according to the exemplary embodiment in the present disclosure may be −60° C. or lower, and may be more preferably −70° C. or lower.

The microstructure of the test piece collected in the t/4 region of the steel manufactured by the manufacturing method according to the exemplary embodiment in the present disclosure may include a composite structure of acicular ferrite and granular bainite, and may further include island martensite as a second phase. In this case, the fraction of the acicular ferrite in the t/4 region may be 60 to 80 area %, and the fraction of the granular bainite in the t/4 region may be 20 to 40 area %. In addition, suppressing the generation of the second phase is more preferable in terms of securing toughness, and the fraction of the island martensite of the present disclosure may be 10 area % or less based on the t/4 region.

The thickness of the steel manufactured by the manufacturing method according to the exemplary embodiment in the present disclosure may be 50 to 120 mm. The steel material may preferably have a thickness of 50 to 100 mm, and more preferably a thickness of 70 to 100 mm.

The yield strength of the steel manufactured by the manufacturing method according to the exemplary embodiment in the present disclosure may be 500 MPa or more, and more preferably 520 MPa or more.

Therefore, according to an exemplary embodiment in the present disclosure, it is possible to provide the manufacturing method of the ultra-thick steel which may effectively guarantee the brittle crack arrestability while having the high strength characteristics, and thus, is particularly suitable as materials of structures such as ships.

MODE FOR INVENTION

Hereinafter, the present disclosure will be described in more detail through Inventive Examples. It should be noted that the following examples are for describing exemplary examples of the present disclosure, and the scope of the present disclosure is not limited by the following examples.

Inventive Example

A steel slab having a thickness of 400 mm provided with alloy compositions of Table 1 was manufactured. After reheating each steel slab in a temperature range of 1030 to 1090° C., rough rolling was performed in a temperature range of 910 to 1040° C. to manufacture a rough-rolled bar, and a total rolling reduction ratio of 40% or more was applied during rough rolling. After the rough rolling, finishing rolling was performed as shown in Table 2 below, and water cooling was performed in the range of 350 to 480° C. at a cooling rate of 3.5 to 5° C./s to manufacture a specimen.

TABLE 1

| Steel | Alloy Composition (wt %) | | | | | | | |
|---|---|---|---|---|---|---|---|---|
| Type No. | C | Mn | P | S | Ni | Cu | Ti | Nb |
| 1 | 0.045 | 1.94 | 0.0048 | 0.0013 | 0.95 | 0.23 | 0.013 | 0.019 |
| 2 | 0.055 | 1.85 | 0.0062 | 0.0008 | 0.84 | 0.18 | 0.012 | 0.016 |
| 3 | 0.032 | 2.08 | 0.0039 | 0.0011 | 0.79 | 0.29 | 0.01 | 0.013 |
| 4 | 0.047 | 1.97 | 0.0044 | 0.0007 | 1.10 | 0.34 | 0.009 | 0.015 |
| 5 | 0.061 | 1.89 | 0.0071 | 0.0009 | 1.02 | 0.27 | 0.011 | 0.009 |
| 6 | 0.12 | 2.01 | 0.0062 | 0.0011 | 0.89 | 0.31 | 0.013 | 0.018 |
| 7 | 0.065 | 2.47 | 0.0057 | 0.0009 | 1.06 | 0.24 | 0.011 | 0.015 |
| 8 | 0.016 | 1.54 | 0.0048 | 0.0015 | 0.85 | 0.21 | 0.012 | 0.013 |
| 9 | 0.055 | 1.97 | 0.0063 | 0.0013 | 0.48 | 0.32 | 0.014 | 0.016 |
| 10 | 0.065 | 2.11 | 0.0046 | 0.0014 | 0.94 | 0.27 | 0.035 | 0.046 |

TABLE 2

| Condition No. | Steel Type No. | Final Thickness (mm) | Finishing Rolling Cumulative Rolling Reduction Ratio (%) | Finishing Rolling Starting Temperature (° C.) | Division |
|---|---|---|---|---|---|
| A | 1 | 90 | 53 | 785 | Specimen 1 |
| B | 2 | 85 | 37 | 759 | Specimen 2 |
| C | 3 | 95 | 55 | 765 | Specimen 3 |
| D | 4 | 100 | 53 | 790 | Specimen 4 |
| E | 5 | 85 | 58 | 736 | Specimen 5 |
| F | 2 | 85 | 37 | 815 | Specimen 6 |
| G | 3 | 95 | 42 | 805 | Specimen 7 |
| H | 6 | 90 | 53 | 764 | Specimen 8 |
| I | 7 | 90 | 51 | 789 | Specimen 9 |
| J | 8 | 85 | 59 | 725 | Specimen 10 |
| K | 9 | 90 | 57 | 787 | Specimen 11 |
| L | 10 | 95 | 54 | 793 | Specimen 12 |
| M | 1 | 90 | 53 | 895 | Specimen 13 |

A microstructure, yield strength, impact transition temperature, and NDT temperature were evaluated for the specimens in Table 2, and the results were shown in Table 3 below. The microstructure was observed and evaluated using an optical microscope and EBSD by collecting a test piece in a t/4−(3*t)/8 region of each specimen, and the yield strength was evaluated by performing a tensile test on each specimen. The impact transition temperature was evaluated as an impact transition temperature at a point where upper absorbed energy is 50% from the results of the impact test performed by lowering the applied temperature range in units from 0° C. to 20° C. for each specimen, and the NDT temperature was evaluated by the DRL-DWT test specified in the ASTM E208-96 by collecting test pieces of t/4 parts of each specimen.

TABLE 3

| Division | Average Grain Size At High Angle Grain Boundary In t/4 − (3*t)/8 region (μm) | Microstructure in t/4 part (area %) | Yield Strength (MPa) | Impact Transition Temperature in t/4 part (° C.) | NDT Temperature in t/4 part (° C.) |
|---|---|---|---|---|---|
| Specimen 1 | 13.2 | AF: 74<br>GB: 21<br>MA: 5 | 539 | −69 | −55 |
| Specimen 2 | 12.8 | AF: 68<br>BF: 28<br>MA: 4 | 554 | −72 | −50 |
| Specimen 3 | 13.3 | AF: 73<br>GB: 24<br>MA: 3 | 549 | −73 | −55 |
| Specimen 4 | 14.5 | AF: 62<br>GB: 33<br>MA: 5 | 565 | −82 | −60 |
| Specimen 5 | 12.8 | AF: 76<br>GB: 20<br>MA: 4 | 538 | −74 | −50 |
| Specimen 6 | 23.2 | AF: 54<br>GB: 40<br>MA: 6 | 582 | −54 | −40 |
| Specimen 7 | 19.7 | AF: 57<br>GB: 37<br>MA: 6 | 569 | −49 | −40 |
| Specimen 8 | 21.2 | AF: 48<br>GB: 23<br>UB: 24<br>MA: 5 | 635 | −48 | −35 |
| Specimen 9 | 23.5 | AF: 32<br>GB: 31<br>UB: 32<br>MA: 5 | 647 | −53 | −35 |
| Specimen 10 | 12.3 | QPF: 27<br>AF: 39<br>MA: 4 | 441 | −65 | −60 |
| Specimen 11 | 13.8 | AF: 71<br>GB: 22<br>MA: 7 | 509 | −57 | −40 |
| Specimen 12 | 16.7 | AF: 62<br>GB: 31<br>MA: 7 | 612 | −42 | −35 |

TABLE 3-continued

| Division | Average Grain Size At High Angle Grain Boundary In t/4 – (3*t)/8 region (μm) | Microstructure in t/4 part (area %) | Yield Strength (MPa) | Impact Transition Temperature in t/4 part (° C.) | NDT Temperature in t/4 part (° C.) |
|---|---|---|---|---|---|
| Specimen 13 | 17.2 | AF: 57<br>GB: 37<br>MA: 6 | 599 | −52 | −45 |

QPF: Quasi-Polygonal Ferrite
AF: Acicular ferrite
GB: Granular Bainite
UB: Upper Bainite
MA: Martensite-Austenite Constituent As shown in Table 3, it may be seen that specimens 1 to 5 satisfying all of the alloy compositions and process conditions of the present disclosure have properties particularly suitable as materials of structures such as ships by satisfying all the average grain size of 15 μm or less at a high angle grain boundary in t/4 to (3*t)/8 parts, the yield strength of 500 MPa or more, the NDT temperature of −45° C. or lower in the t/4 part, and the impact transition temperature of −60° C. or lower in the t/4 part. FIG. 1 is a photograph of a t/4 portion of specimen 1 observed with an optical microscope, and it can be seen that a composite structure of fine acicular ferrite and granular bainite are provided.

In the case of specimens 6 and 7, it may be seen that as the finishing rolling was performed at the rolling reduction ratio lower than the total cumulative reduction ratio of the finishing rolling suggested by the present disclosure, a sufficient deformation was not applied to the t/4 part, and thus, the acicular ferrite greatly affecting the refinement of the particle size was not sufficiently formed and a large amount of coarse bainite was formed, so the particle size was coarse. That is, in the case of specimens 6 and 7, it may be seen that the average grain size at the high angle grain boundary in t/4 to (3*t)/8 parts exceeded 15 μm, the NDT temperature of the t/4 portion exceeded −45° C., and the impact transition temperature of the t/4 portion exceeded −60° C., so the specimens 6 and 7 did not have the desired properties.

In the case of specimen 8, it may be seen that since the specimen 8 contained a higher content of carbon (C) than the content of carbon (C) suggested by the present disclosure, the yield strength was high due to high hardenability, but a large amount of coarse bainite was generated. That is, in the case of the specimen 8, it may be seen that the average grain size at the high angle grain boundary in t/4 to (3*t)/8 parts exceeded 15 μm, the NDT temperature of the t/4 portion exceeded −45° C., and the impact transition temperature of the t/4 portion exceeded −60° C., so the specimen 8 did not have the desired properties.

In the case of specimen 9, it may be seen that since the specimen 9 contained a higher content of manganese (Mn) than the content of manganese (Mn) suggested by the present disclosure, the yield strength was high due to high hardenability, but a large amount of coarse bainite was generated. That is, even in the case of the specimen 9, it may be seen that the average grain size at the high angle grain boundary in t/4 to (3*t)/8 parts exceeded 15 μm, the NDT temperature of the t/4 portion exceeded −45° C., and the impact transition temperature of the t/4 portion exceeded −60° C., so the specimen 9 did not have the desired properties.

In the case of specimen 10, it may be seen that since the specimen 10 contained a lower content of carbon (C) and manganese (Mn) than the content of carbon (C) and manganese (Mn) suggested by the present disclosure, a large amount of soft structure such as polygonal ferrite was formed in the t/4 part, so the specimen 10 did not have the desired yield strength.

In the case of specimen 11, it may be seen that since specimen 11 contained a lower content of nickel (Ni) than the nickel (Ni) content suggested by the present disclosure, even if fine bainite was sufficiently formed on the surface part, the decrease in toughness was caused by the low content of nickel (Ni). That is, in the case of specimen 11, it may be seen that the NDT temperature of the t/4 portion exceeded −45° C., and the impact transition temperature of the t/4 portion exceeded −60° C., so that specimen 11 did not have the desired properties.

In the case of specimen 12, it may be seen that since the specimen 12 contained a higher content of titanium (Ti) and niobium (Nb) than the content of titanium (Ti) and niobium (Nb) suggested by the present disclosure, the decrease in toughness was caused by excessive hardenability and generation of precipitates. That is, even in the case of specimen 12, it may be seen that the NDT temperature of the t/4 portion exceeded −45° C., and the impact transition temperature of the t/4 portion exceeded −60° C., so that specimen 12 did not have the desired properties.

In the case of specimen 13, it may be seen that as the finishing rolling was performed at higher temperature than the temperature range of the finishing rolling suggested by the present disclosure, a sufficient deformation band did not remain in austenite, and thus, the acicular ferrite greatly affecting the refinement of the particle size was not sufficiently formed and a large amount of coarse bainite was formed, so the particle size was coarse. That is, in the case of the specimen 13, it may be seen that the average grain size at the high angle grain boundary in t/4 to (3*t)/8 parts exceeded 15 μm, and the impact transition temperature of the t/4 portion exceeded −60° C., so that specimen 13 did not have the desired properties.

As set forth above, according to an exemplary embodiment in the present disclosure, it may be seen that it is possible to provide an ultra-thick steel which may effectively guarantee brittle crack arrestability while having high strength characteristics, and thus, is particularly suitable as materials of structures such as ships, and a manufacturing method therefor.

While the present disclosure has been described in detail through exemplary embodiment, other types of exemplary embodiments are also possible. Therefore, the technical spirit and scope of the claims set forth below are not limited to exemplary embodiments.

The invention claimed is:

1. A steel comprising:

by wt %, 0.02 to 0.07% of C, 1.8 to 2.2% of Mn, 0.7 to 1.2% of Ni, 0.005 to 0.02% of Nb, 0.005 to 0.02% of Ti, 0.1 to 0.4% of Cu, 0.01% or less of P, 0.004% or less of S, and a balance of Fe and inevitable impurities, wherein grains that have a high angle grain boundary of 15° or more, as measured by EBSD, have an average grain size of 15 μm or less in the t/4−(3*t)/8 region, where t represents a thickness of the steel, and the same below, wherein a microstructure of a test piece collected in the t/4 region of the steel includes a composite structure of acicular ferrite and granular bainite, and further includes island martensite as a second phase, wherein the acicular ferrite is included in a ratio of 60 to 80 area %, the granular bainite is included in a ratio of 20 to 40 area %, the island martensite is included in a ratio of greater than 0% 10 area % or less, and wherein a naval research laboratory-drop weight test (NRL-DWT) specified in ASTM E208-06 is performed on a test piece collected in the t/4 region of the steel, a Nil-ductility transition (NDT) temperature is −45° C. or lower.

2. The steel of claim 1, wherein an impact transition temperature of a test piece collected in the t/4 region of the steel is −60° C. or lower.

3. The steel of claim 1, wherein a thickness of the steel is 50 to 120 mm.

4. The steel of claim 1, wherein a yield strength of the steel is 500 MPa or more.

5. A manufacturing method of a steel the steel according to claim 1, comprising:

reheating a slab including, by wt %, 0.02 to 0.07% of C, 1.8 to 2.2% of Mn, 0.7 to 1.2% of Ni, 0.005 to 0.02% of Nb, 0.005 to 0.02% of Ti, 0.1 to 0.4% of Cu, 0.01% or less of P, 0.004% or less of S, and the balance of Fe and inevitable impurities;

rough rolling the reheated slab;

finishing rolling the roughly rolled slab at a cumulative reduction rate of 50% or more;

cooling the finishing-rolled steel material; and initiating the finishing rolling in a temperature range of 700 to 850° C., wherein the slab is reheated in a temperature range of 1000 to 1120° C., wherein the reheated slab is roughly rolled at a cumulative rolling reduction rate of 40% or more in a temperature range of 850 to 1050° C., and wherein the finishing-rolled steel is cooled to a temperature range of 500° C. or lower at a cooling rate of 3° C./s or more.

* * * * *